US011725456B2

(12) United States Patent
Purcell et al.

(10) Patent No.: US 11,725,456 B2
(45) Date of Patent: Aug. 15, 2023

(54) HYDRAULIC DOWN-THE-HOLE HAMMER AND SUBSEA PILE

(71) Applicant: Mincon International Limited, Shannon (IE)

(72) Inventors: Joseph Purcell, Ennis (IE); Markku Keskiniva, Ylinen (FI)

(73) Assignee: Mincon International Limited, Shannon (IE)

( * ) Notice: Subject to any disclaimer, the term of this patent is extended or adjusted under 35 U.S.C. 154(b) by 23 days.

(21) Appl. No.: 17/731,594

(22) Filed: Apr. 28, 2022

(65) Prior Publication Data

US 2022/0349256 A1 Nov. 3, 2022

(30) Foreign Application Priority Data

Apr. 29, 2021 (IE) ..... 2021/0091
Apr. 30, 2021 (IE) ..... 2021/0095

(51) Int. Cl.

| | |
|---|---|
| ***E21B 4/14*** | (2006.01) |
| ***E02D 5/34*** | (2006.01) |
| ***E02D 7/28*** | (2006.01) |
| *E02D 27/52* | (2006.01) |

(52) U.S. Cl.

CPC ..... *E21B 4/14* (2013.01); *E02D 5/34* (2013.01); *E02D 7/28* (2013.01); *E02D 27/525* (2013.01)

(58) Field of Classification Search

CPC ..... E21B 4/14; E02D 27/525; E02D 27/52; E02D 5/34; E02D 7/28; E02D 15/08; E02D 7/06

See application file for complete search history.

(56) References Cited

U.S. PATENT DOCUMENTS

| | | | | |
|---|---|---|---|---|
| 5,715,897 | A * | 2/1998 | Gustafsson | E21B 4/14 173/17 |
| 6,499,544 | B1 * | 12/2002 | Shofner | E21B 4/14 173/136 |
| 2016/0230485 | A1 * | 8/2016 | Purcell | E21B 17/18 |
| 2020/0340321 | A1 * | 10/2020 | Moyes | E21B 31/005 |
| 2022/0081974 | A1 * | 3/2022 | Bruandet | E21B 4/14 |
| 2022/0098943 | A1 * | 3/2022 | Bruandet | E21B 4/14 |

FOREIGN PATENT DOCUMENTS

| | | | | |
|---|---|---|---|---|
| EP | 0889195 | * | 7/1999 | E21B 4/14 |

* cited by examiner

*Primary Examiner* — Yong-Suk (Philip) Ro
(74) *Attorney, Agent, or Firm* — Kusner & Jaffe

(57) ABSTRACT

The present invention relates to a hydraulic down-the-hole hammer. The hammer comprises an elongate shaft and a piston having a central bore therethrough, the piston slidably mounted for reciprocal movement on the shaft and arranged to impact a percussion bit. Forward and rear drive chambers for the piston are disposed between the piston and the shaft and the forward chamber is separated from the rear chamber by an annular shoulder formed internally of the piston bore. The hammer also comprises a control valve to control reciprocation of the piston, wherein the control valve is arranged within the central bore of the piston. The hammer may be a disposable water hammer in which the piston is an outermost component of the hammer.

15 Claims, 16 Drawing Sheets

HYDRAULIC DOWN-THE-HOLE HAMMER AND SUBSEA PILE

FIELD OF THE INVENTION

The present invention relates to fluid-operated hydraulic down-the-hole hammers, and in particular, to a disposable or single-use hydraulic down-the-hole hammer. The present invention also relates to a subsea pile, and to methods and systems for installing a load-bearing element and a subsea anchor in a seabed.

BACKGROUND TO THE INVENTION

Hydraulically powered down-the-hole hammers generally include three principal components—an impact piston to impart percussion energy to a drill bit or tool located at a forward end of the hammer; a shuttle or control valve to control the flow of hydraulic fluid in the hammer, to apply pressure to faces of the impact piston, thereby creating cyclical forces that cause reciprocal motion of the piston; and one or more accumulators to take in, store and deliver back pressurised hydraulic fluid to accommodate the varying instantaneous flow requirements created by the reciprocation of the piston.

A conventional hydraulic down-the-hole hammer 100 is shown in FIG. 1. In such conventional hammers, the piston 101 is typically solid and reciprocates within an outer cylinder to impact a bit 109 at a forward end of the hammer. The piston drive chambers 102, 103 are arranged between the piston and an outer cylinder 104, and the control valve 105 and accumulators 106 are positioned at a rear end 107 of the piston. Working fluid is provided to the hammer via pressure line P and returned via return line T. A separate flow of flushing fluid 108 is provided to flush cuttings from the hole. Because of the position of the control valve, the distance $d_{valve}$ between the control valve and the drive chambers is relatively large. The accumulators 106 are typically upstream of the valve 105 and so the distance $d_{accu}$ between the accumulators and the drive chambers is even greater. The long flow channels between the piston and the valve and accumulators can generate pressure waves that can be harmful to the hammer components. The long flow channels also result in pressure losses. The accumulators do not operate efficiently, since the communication delay between the piston and the accumulators is substantial, due to the distance between them.

In a typical water-powered hydraulic hammer, the set-up is similar to that outlined above and shown in FIG. 1. However, in the water-powered hammer 200 shown in FIG. 2, there is no return line T. Instead, the drive fluid is used for flushing flow 208. Furthermore, the piston 201 is fully submerged in water and only a small portion of the cross-sectional area of the piston is used to drive the piston. The rest of the cross-sectional area is idling, as it is exposed to water at ambient pressure. This means that the non-driving area of the piston needs to displace a large amount of water during operation of the hammer. This is achieved by having a central bore 210 through the piston so that the forward 211 and rear 207 ends of the piston are in fluid communication with one another. The bore must be sufficiently large to avoid a significant pressure loss, which would negatively affect hammer performance. Pressure losses can also be reduced by minimising the size of the non-driving areas of the piston. Increasing the size of the central bore and decreasing the size of the non-driving areas of the piston results in a piston with a very small cross-sectional area, which tends to be too lightweight for effective drilling. This is addressed by increasing the length of the piston in order to provide sufficient weight. However, this in turn leads to a hammer that is impractical due to its length, an issue which is exacerbated by the position of the valve to the rear of the piston. Existing water hammers are also complex in design and therefore expensive to produce.

It would be desirable to provide a hydraulic down-the-hole hammer that addresses some of the disadvantages associated with existing arrangements.

Subsea piles may be used to anchor structures used to moor offshore structures such as wind turbines to the seabed. The upper layers of the seabed are often composed of soil or silt and may be weak or unstable. A pile is a load-bearing element that extends through these upper layers to lower, more stable layers of compacted soil and rock, thereby transferring the load from the anchored structure to these lower layers of the seabed.

Existing terrestrial pile installation involves drilling a hole using a hammer, with a casing being pulled down the hole by the hammer as the hole is drilled. Once the hole has reached a target depth, the hammer is removed from the hole, leaving the casing in place. A reinforcing steel bar is dropped down the centre of the casing and the hole is then filled with grout. The casing may be removed before the grout is cured, in which case the grout bonds the reinforcing steel bar to the material of the surrounding terrain.

However, subsea pile installation presents a number of difficulties which mean that such terrestrial installation methods are unsuitable. One common method of fixing subsea anchors to the seabed is using driven piles, where the pile is driven into the seabed by a large underwater hydraulic hammer. Alternatively, a suction pile installation method may be used where a hollow pile is dropped onto the seabed, creating a seal between the bottom of pile and the seabed. Water is then pumped out from the hollow centre of the pile to create a suction effect which pulls the pile further down into the seabed.

Subsea piles as described above may be used to fix a subsea anchor to the seabed. Such subsea anchors may comprise a frame or template which is fixed to the seabed using one or more piles. A wind turbine or other offshore structure can then be moored or otherwise fixed to the subsea anchor.

A method for installation of such subsea pile anchors is disclosed in United States Patent Application Publication No. US 2015/0233079. The method involves placing a frame on the seabed, arranging a seabed drill on the frame and using the drill to drive a pile anchor into the seabed. Grout is then pumped around the pile anchor to bond the pile to the ground. This process may be repeated for several pile anchors to fix the frame to the seabed. A mooring connection on the frame may then be used to moor an offshore structure to the anchor.

There are a number of disadvantages associated with these installation methods. Both driven piles and suction piles are relatively slow to install. For driven piles, the underwater hammer is large, complex and expensive and requires a large support vessel. The suction method is only suitable where the seabed is soft and sandy, and cannot be used where there are boulders or obstacles.

It would be desirable to provide a method and system for installing a pile or load-bearing element in a seabed, for example, for anchoring a structure such as a wind turbine, which overcomes some of the disadvantages associated with existing methods.

SUMMARY OF THE INVENTION

According to an aspect of the present invention, there is provided a hydraulic down-the-hole hammer comprising:

an elongate shaft;

a piston having a central bore therethrough, the piston slidably mounted for reciprocal movement on the shaft and arranged to impact a percussion bit, wherein forward and rear drive chambers for the piston are disposed between the piston and the shaft and wherein the forward chamber is separated from the rear chamber by an annular shoulder formed internally of the piston bore; and a control valve to control reciprocation of the piston, wherein the control valve is arranged within the central bore of the piston.

The term "forward" is used herein to indicate an end of the hammer towards the percussion bit, that is, the drilling end of the hammer. The term "rear" is used herein to indicate an end of the hammer, away from the percussion bit, that is, an end of the hammer that is uppermost during drilling.

There are several advantages associated with this arrangement. Because the valve is arranged within the piston, the distance travelled by the fluid between the valve and the drive chambers is minimised, thereby eliminating harmful pressure waves. Pressure losses are also very low. Because the drive chambers are inside the piston, rather than between the piston and an outer sleeve, the sealing diameters are reduced as compared with a conventional hammer. This reduces leakage which is particularly important for water-powered hammers due to the low viscosity of the working fluid. The hammer is also less expensive to produce due to its simple design.

Preferably, the control valve is arranged internally of the shaft.

In preferred embodiments, the piston has a monolithic or unitary construction, that is, it is formed as a single piece. Because the annular shoulder on the piston dividing the forward and rear chambers is provided on the inside of the piston bore, it is possible to manufacture and assemble the piston into the hammer in a single piece.

Ideally, the piston is arranged to impact an annular shoulder at a rear end of the percussion or drill bit. The annular shoulder may be provided on the skirt of the drill bit. An advantage of this arrangement is that the impact force is transmitted directly to the gauge of the drill bit at the point where the highest impact energy is required for drilling.

In certain embodiments, the hammer may comprise at least one accumulator arranged at a rear end of the piston. Because the valve is arranged within the piston, the accumulator or accumulators may be positioned much closer to the piston than in conventional arrangements, thereby reducing $d_{accu}$ and consequently improving efficiency.

In an embodiment of the hammer, the working fluid is water. In this embodiment, the rear chamber may be connected to a pressure fluid channel and the control valve may be arranged to connect the forward chamber to the rear chamber while the piston is moving in a rearward direction and arranged to connect the forward chamber to a flushing fluid channel through the shaft and the percussion bit when the piston is moving in a forward direction. Because the rear chamber is connected to a pressure fluid channel throughout the piston cycle, there is a constant pressure in the rear chamber and an alternating pressure in the forward chamber.

In some embodiments, the hammer may further comprise an outer wear sleeve, such that the piston is housed within the wear sleeve. As in conventional hammers, the outer wear sleeve protects the piston from wear during drilling. The percussion bit may be arranged at a forward end of the wear sleeve. In an embodiment, the hammer is a closed-loop hammer and a flushing fluid channel may be provided between the piston and the wear sleeve and through the percussion bit. This means that the full outer surface of the piston may be exposed to flushing flow, thereby providing very efficient cooling for the piston.

In another embodiment, a working fluid of the hammer is water and a flow annulus is provided between the piston and the outer wear sleeve to provide fluid communication between forward and rear ends of the piston. A flushing fluid channel is provided through the shaft and the percussion bit. Because the drive chambers of the hammer are provided inside the piston bore, the flow communication between forward and rear ends of the piston may be provided by the flow annulus on the outside of the piston, rather than via the piston bore as in conventional water hammers. Such a flow annulus has inherently large flow area even with a small radial clearance between the piston and wear sleeve. This means that the cross-sectional area of the piston may be increased as compared with conventional water hammers, thereby allowing sufficient piston weight to be achieved with a short piston. The placement of the valve within the piston further decreases the length of the hammer.

According to an aspect of the present invention, the piston is the outermost component of the hammer. That is, the hammer does not include an outer wear sleeve to house the piston. By omitting the conventional outer wear sleeve from the hammer, the cost of the hammer is reduced, allowing it to be used as a single-use, sacrificial or disposable hammer. Because the piston is the outermost component of the hammer, it will be exposed to wear from cuttings. However, since the hammer is disposable, the piston need only last long enough to drill a single hole. For example, the hammer may be left in the hole when the hole has been drilled.

A flushing port may be provided in the shaft extending from the central bore of the shaft to an outer surface of the shaft at a forward end of the piston. This allows a portion of the flushing water to exit between strike faces of the piston and the bit, thereby flushing cuttings away from the strike faces to avoid damage thereto.

In various embodiments of the hammer according to the present invention, the shaft may comprise a coupling element at forward end thereof, wherein the coupling element couples the percussion bit to the hammer and transmits rotational drive thereto.

Engagement means may be formed on the coupling element engageable with complementary engagement means formed internally of the bit whereby rotational drive from the shaft may be transmitted to the bit. In an embodiment, the coupling element is formed with a central bore and the flushing port is provided in the coupling element, extending from the central bore thereof to an outer surface of the coupling element at a forward end of the piston. The engagement means may comprise a plurality of axially extending splines formed externally of the coupling element and the complementary engagement means may comprise a corresponding plurality of axially extending splines formed internally of the bit. In other embodiments, the engagement means may comprise a portion of the coupling element with a hexagonal or square cross-section, and the complementary engagement means may comprise an internal portion of the bit formed with a correspondingly-shaped inner wall.

The hammer may further comprise bit retaining means on the coupling element adapted for engagement with complementary retaining means on the bit to retain the bit in the hammer. The bit retaining means may comprise a first screw thread formed externally of the coupling element at a forward end thereof, and the complementary engagement means may comprise a second screw thread formed internally of the bit. The hammer bit may be assembled to the hammer by threading the bit onto the coupling element such that the first screw thread is located forward of the second screw thread. This arrangement retains the bit in the hammer and allows limited longitudinal movement of the bit.

In another embodiment, the bit retaining means comprises a bit retaining ring, comprising a plurality of part-annular sectors, and the complementary engagement means comprises a shoulder formed internally of the bit. In this embodiment, the coupling element may comprise a chuck.

DETAILED DESCRIPTION OF THE DRAWINGS

Figure 3:
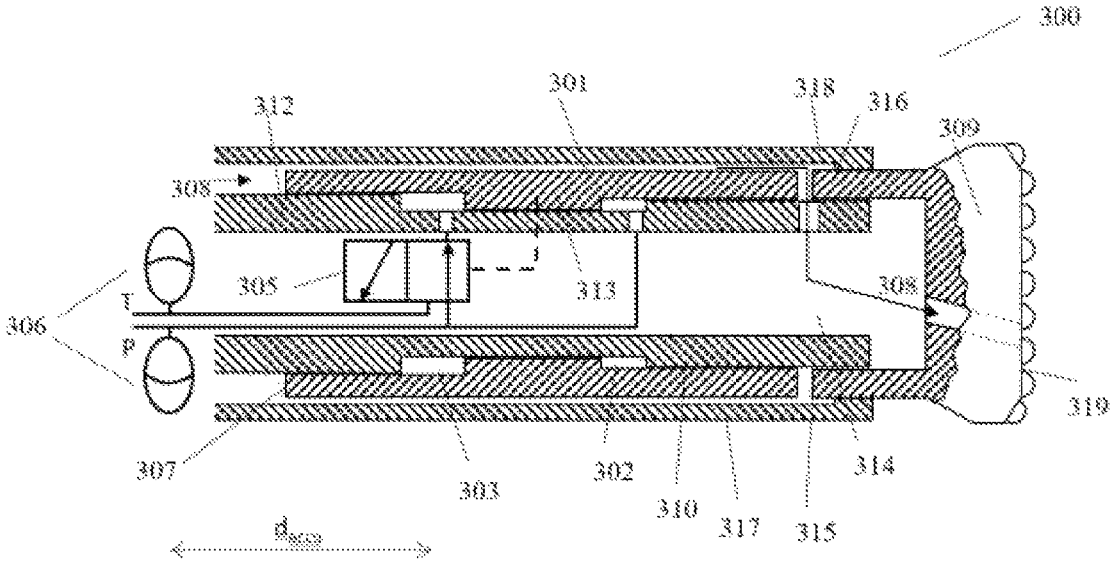
FIG. 3 is a schematic representation of a hydraulic down-the-hole hammer according to an embodiment of the present invention.

A hydraulic down-the-hole hammer 300 according to an embodiment of the present invention is illustrated in FIG. 3. The hammer comprises an elongate shaft 312 formed with a central bore 314. A piston 301 also has a central bore 310 therethrough. The shaft is received within the piston bore such that the piston is slidably mounted for reciprocal movement on the shaft 312 and arranged to impact an annular shoulder 315 at a rear end 316 of a percussion bit 309. The piston 301 is housed within an outer wear sleeve 317, and the percussion bit 309 is arranged at a forward end 318 of the wear sleeve.

Forward 302 and rear 303 drive chambers for the piston are disposed between the piston 301 and the shaft 312. An annular shoulder 313 on the piston formed internally of the piston bore 310 separates the forward chamber 302 from the rear chamber 303. An internal diameter of the piston 301 to the rear of the shoulder 313 is greater than the internal diameter of the piston forward of the shoulder, such that the rear chamber has a larger driving area than the forward chamber. The hammer also comprises a control valve 305 arranged within the central bore 314 of the shaft to control reciprocation of the piston. In other embodiments, the valve 305 may be arranged within the central bore 310 of the piston, between the piston and the shaft.

The hammer 300 is a closed-loop hammer in which working fluid is provided to the hammer via pressure line P and returned via return line T. A flushing fluid channel 308 is provided between the piston 301 and the wear sleeve 317 and through the percussion bit 309, such that the flushing fluid exits the channel at the bit face 319.

The hammer 300 further comprises pressure and return fluid accumulators 306 arranged at a rear end 307 of the piston. The accumulators are arranged a distance $d_{accu}$ from the rear drive chamber 303 of the piston.

Figure 4:
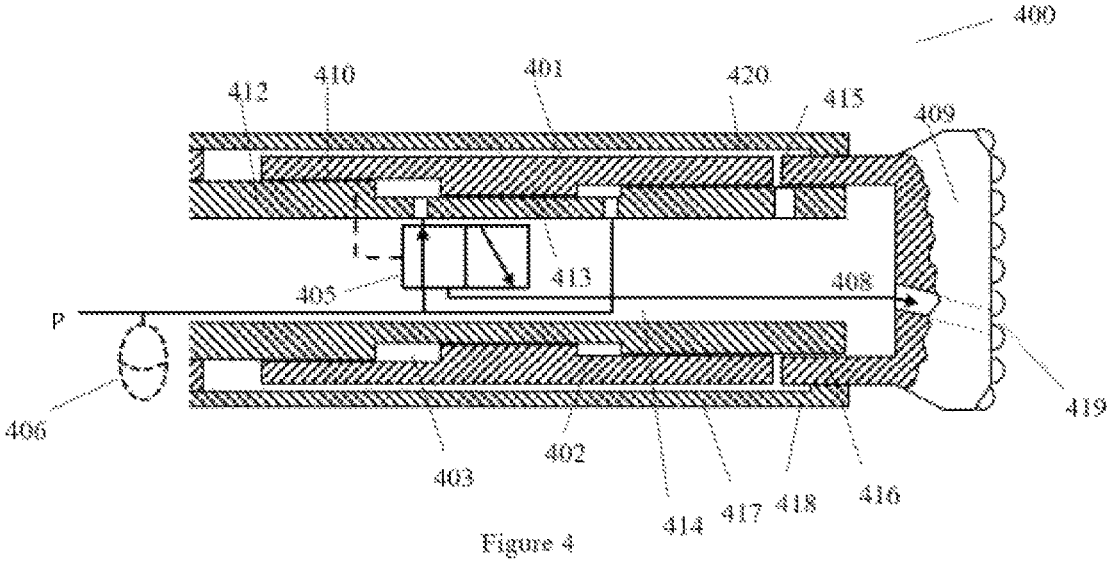
FIG. 4 is a schematic representation of a water hammer according to an embodiment of the present invention.

A hydraulic down-the-hole hammer 400 according to another embodiment of the invention is illustrated in FIG. 4. As in the embodiment of FIG. 3, the hammer comprises an elongate shaft 412 formed with a central bore 414. A piston 401 also has a central bore 410 therethrough. The shaft is received within the piston bore such that the piston is slidably mounted for reciprocal movement on the shaft 412 and arranged to impact an annular shoulder 415 at a rear end 416 of a percussion bit 409. The piston 401 is housed within an outer wear sleeve 417, and the percussion bit 409 is arranged at a forward end 418 of the wear sleeve.

Forward 402 and rear 403 drive chambers for the piston are disposed between the piston 401 and the shaft 412. An annular shoulder 413 on the piston formed internally of the piston bore 410 separates the forward chamber 402 from the rear chamber 403. An internal diameter of the piston 401 to the rear of the shoulder 413 is greater than the internal diameter of the piston forward of the shoulder, such that the rear chamber has a larger driving area than the forward chamber. The hammer also comprises a control valve 405 arranged within the central bore 414 of the shaft to control reciprocation of the piston.

Figure 1:
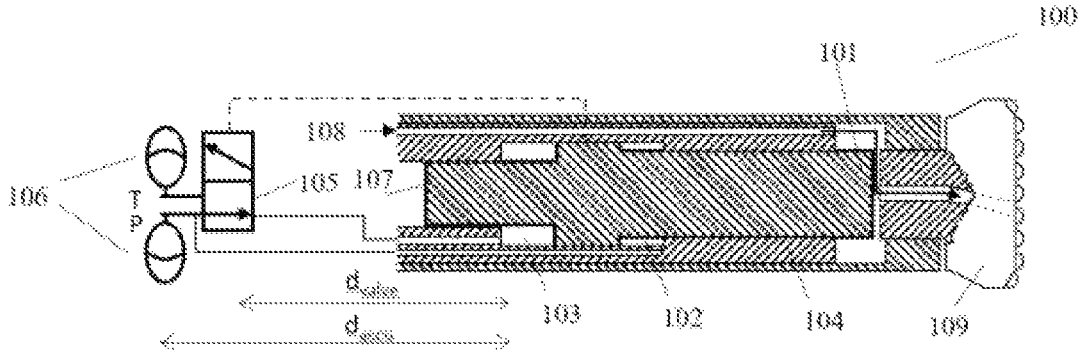
FIG. 1 is a schematic representation of a conventional hydraulic down-the-hole hammer.
Figure 2:
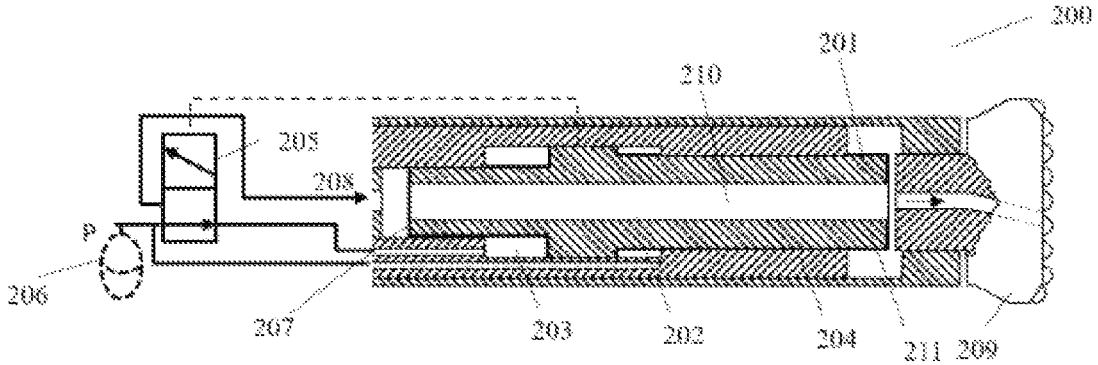
FIG. 2 is a schematic representation of a conventional down-the-hole water hammer.

The hammer 400 shown in FIG. 4 is an open-loop hammer in which a working fluid such as water is provided to the hammer via pressure line P. However, unlike the hammer of FIG. 3, the hammer 400 does not have a return line. Instead, the drive fluid is used for flushing flow 408 through the central bore 414 of the shaft and the percussion bit 409 to exit at the bit face 419. Unlike prior art hammers, the outer surface of the piston is not a sealing surface and so a flow annulus 420 to allow fluid communication between the forward and rear ends of the piston is provided between the piston and the wear sleeve, rather than via the piston bore as in the conventional water hammer shown in FIG. 2. This allows the cross-sectional area of the piston to be increased as compared with such conventional water hammers, thereby allowing sufficient piston weight to be achieved with a short piston. The placement of the valve 405 within the piston allows the distance $d_{accu}$ to be reduced and further decreases the length of the hammer.

Figure 5:
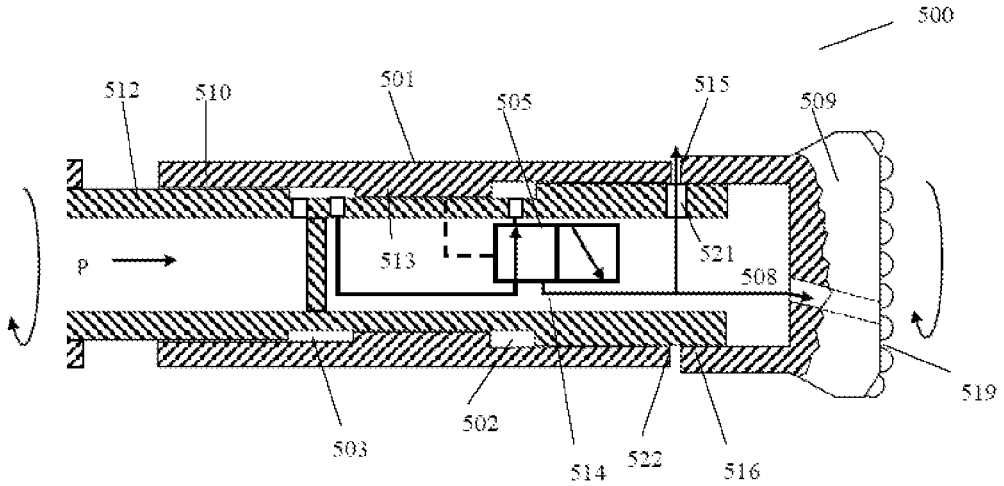
FIG. 5 is a schematic representation of a disposable water hammer according to an embodiment of the present invention.

A low-cost disposable or single-use hydraulic down-the-hole hammer 500 according to an embodiment of the invention is illustrated in FIG. 5. As in the embodiment of FIG. 4, the hammer comprises an elongate shaft 512 formed with a central bore 514. A piston 501 also has a central bore 510 therethrough. The shaft is received within the piston bore such that the piston is slidably mounted for reciprocal movement on the shaft 512 and arranged to impact an annular shoulder 515 at a rear end 516 of a percussion bit 509. Forward 502 and rear 503 drive chambers for the piston are disposed between the piston 501 and the shaft 512. An annular shoulder 513 on the piston formed internally of the piston bore 510 separates the forward chamber 502 from the rear chamber 503. In this embodiment, an internal diameter of the piston 501 to the rear of the shoulder 513 is smaller than the internal diameter of the piston forward of the shoulder, such that the forward chamber has a larger driving area than the rear chamber. The hammer also comprises a control valve 505 arranged within the central bore 514 of the shaft to control reciprocation of the piston.

Like the hammer of FIG. 4, the hammer 500 shown in FIG. 5 is an open-loop hammer in which a working fluid such as water is provided to the hammer via pressure line P. However, unlike the hammer of FIG. 4, the hammer 500 does not include an outer sleeve, so that the piston 501 is the outermost component of the hammer. This reduces the cost of the hammer so that it can be used as a disposable or sacrificial hammer that is used to drill a single hole only.

In this embodiment, the rear chamber 503 is connected to a pressure fluid channel P so that there is a constant pressure in the rear chamber. The control valve 505 is arranged to connect the forward chamber 502 to the rear chamber 503 while the piston is moving in a rearward direction and to connect the forward chamber 502 to a flushing fluid channel 508 through the central bore of the shaft and the percussion bit when the piston is moving in a forward direction, so that there is an alternating pressure in the forward chamber 502.

Because the hammer 500 does not include an outer wear sleeve or cylinder, the piston itself will be exposed to wear from drill cuttings. However, since the hammer is disposable, the piston need only last long enough to drill a single hole. In addition, radial flushing ports 521 extend from the central bore 514 of the shaft to an outer surface of the shaft, allowing part of the exhaust fluid to exit between a forward end 522 of the piston 501 and the strike face 515 of the bit. This keeps drill cuttings away from the strike faces of the bit and the piston and prevents premature damage to the strike faces.

Figure 6A:
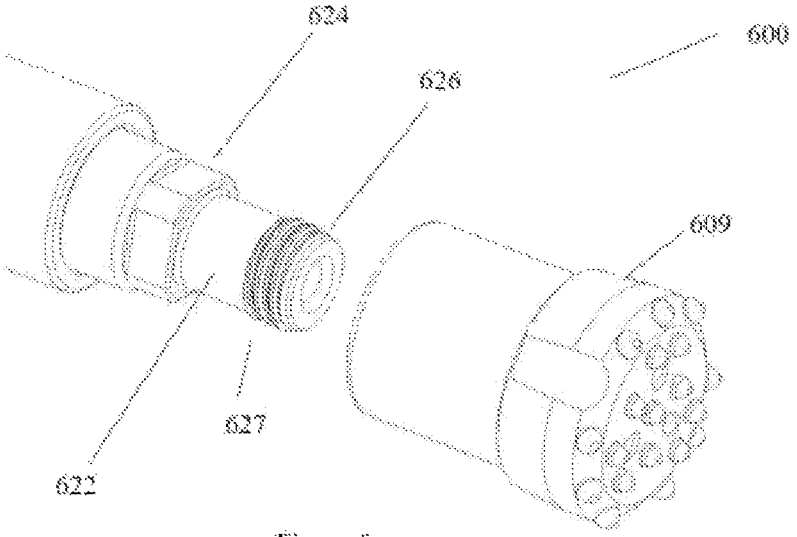
FIG. 6*a* is a perspective view of a coupling element and a bit of a hammer according to the present invention.
Figure 6B:
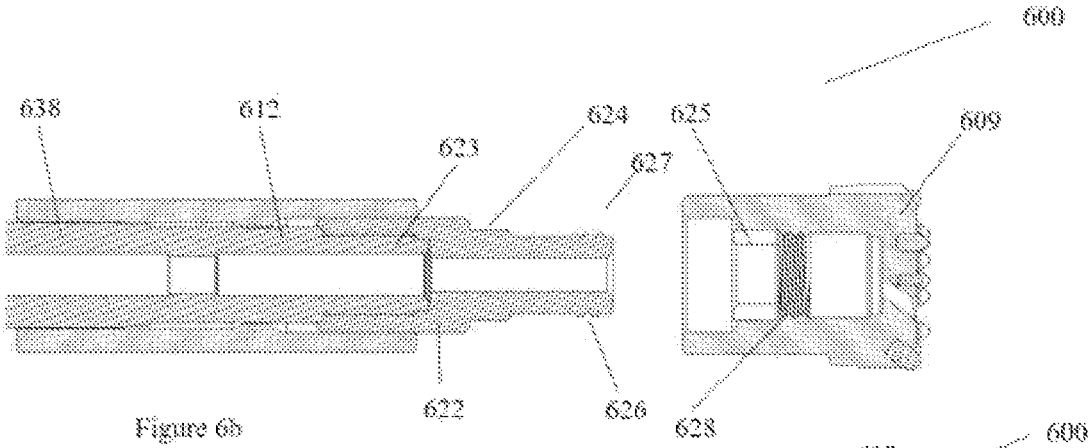
FIG. 6*b* is a cross-sectional view of the coupling element and bit of FIG. 6*a*, in which the coupling element is assembled to a piston and shaft of the hammer.
Figure 6C:
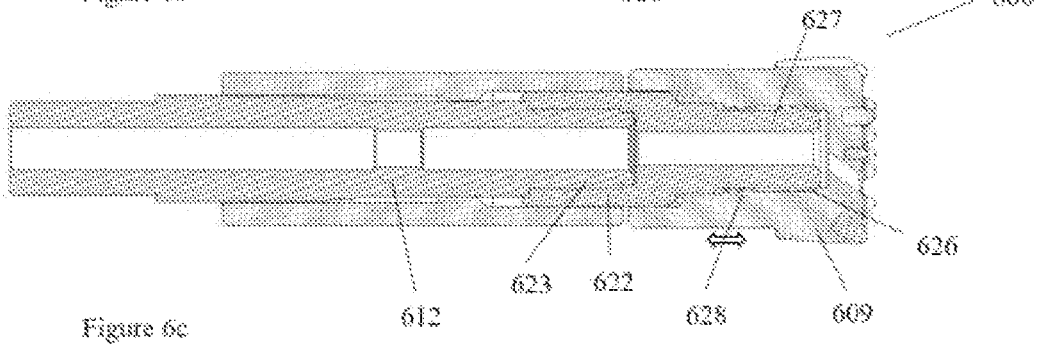
FIG. 6*c* is a cross-sectional view of the assembly of FIG. 6*b*, in which the bit is coupled to the coupling element.

FIGS. 6*a*, 6*b* and 6*c* illustrate a coupling arrangement for coupling a percussion bit to a hammer according to the present invention. Hammer 600 shown in FIGS. 6*a*, 6*b* and 6*c* is similar in several respects to disposable hammer 500 shown in FIG. 5 but the coupling arrangement shown may also be applied to hammers 300, 400 shown in FIGS. 3 and 4, as well as other hammers in accordance with the invention.

The shaft 612 of hammer 600 comprises a coupling element 622 at forward end 623 thereof. As shown in FIGS. 6*b* and 6*c*, an outer diameter of the coupling element is greater than an outer diameter of a main body 638 of the shaft, so that the forward chamber is sealed by the coupling element and the piston. A portion 624 of the coupling element is formed with a square cross-section and a corresponding internal portion 625 of the bit 609 is formed with a square-shaped inner wall, such that, when the bit is assembled to the coupling element of the shaft, the portion 624 of the coupling element is received within the portion 625 of the bit, to allow rotational drive to be transmitted from the shaft to the bit. In other embodiments, the portion 624 of the coupling element may be formed with a hexagonal or octagonal cross-section and the internal portion of the bit may be correspondingly shaped. In further embodiments, axially-extending splines may be provided externally of the coupling element, engageable with corresponding splines provided internally of the bit, for transmission of rotational drive.

The coupling element 622 further comprises bit retaining means engageable with complementary bit retaining means on the bit 609 for longitudinal coupling of the bit to the hammer. In the embodiment shown in FIGS. 6*a*, 6*b* and 6*c*, the bit retaining means comprises a first screw thread 626 formed externally of the coupling element 622 at a forward end 627 thereof. The complementary engagement means comprises a second screw thread 628 formed internally of the bit.

The bit is coupled to the hammer by threading the second screw thread 628 bit through the first screw thread 626 such that the first screw thread is forward of the second screw thread. This couples the bit to the coupling element in a longitudinal direction and retains the bit in the hammer, while allowing limited longitudinal movement of the bit. Next, the bit is rotated to line up the portion 625 of the bit with the square-shaped portion 624 of the coupling element, such that the portion 624 of the coupling element is received within portion 625 of the bit to engage the rotational coupling. The coupling element 622 is coupled to the main body 638 of the shaft by way of a screw-threaded connection.

Figure 7A:
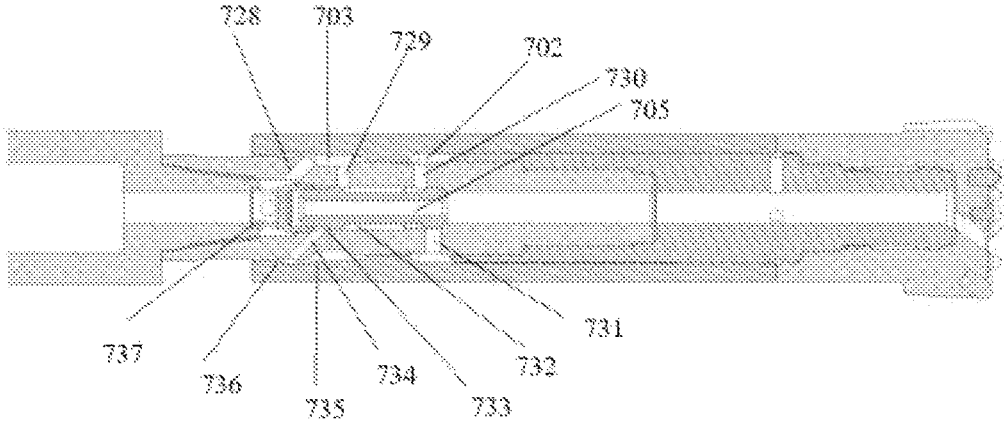
FIG. 7*a* is a cross-sectional view of a disposable water hammer according to an embodiment of the present invention.
Figure 7B:
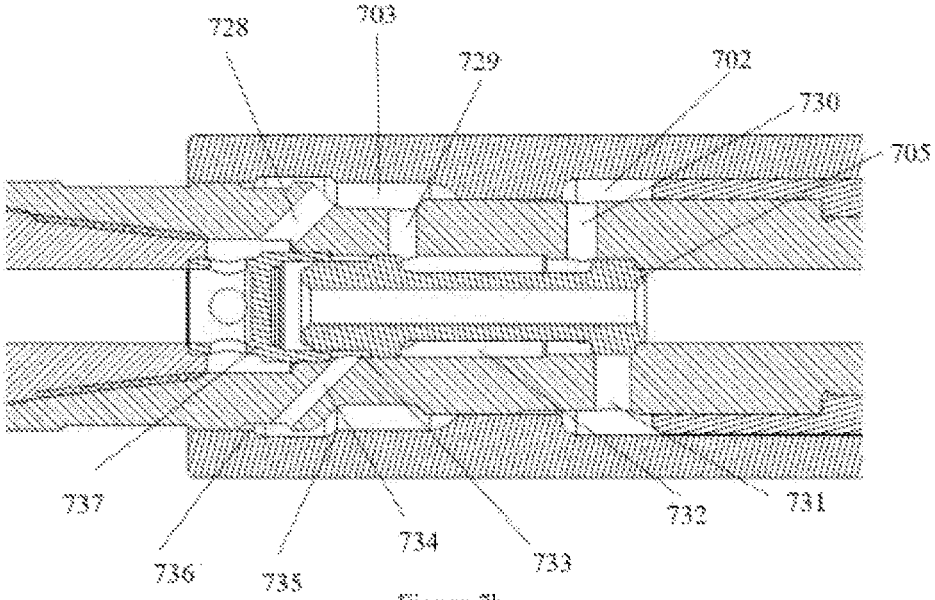
FIG. 7*b* is a detail view of a portion of the hammer of FIG. 7*a;*

A control valve 705 suitable for use in a hammer 700 according to the present invention is illustrated in FIGS. 7*a* and 7*b*. The valve is particularly suitable for a disposable hammer according to the present invention, such as that shown in FIG. 5. The valve 705 comprises a top or rear inlet port 728 and a top or rear outlet port 729. The valve further comprises a bottom or forward inlet port 730 and a bottom or forward outlet port 731. Also shown in FIG. 7*a* are the valve chamber 732, the pilot chamber 733, the pilot port 734, the front control edge 735, rear control edge 736 and the control valve cap 737.

Figure 8A:
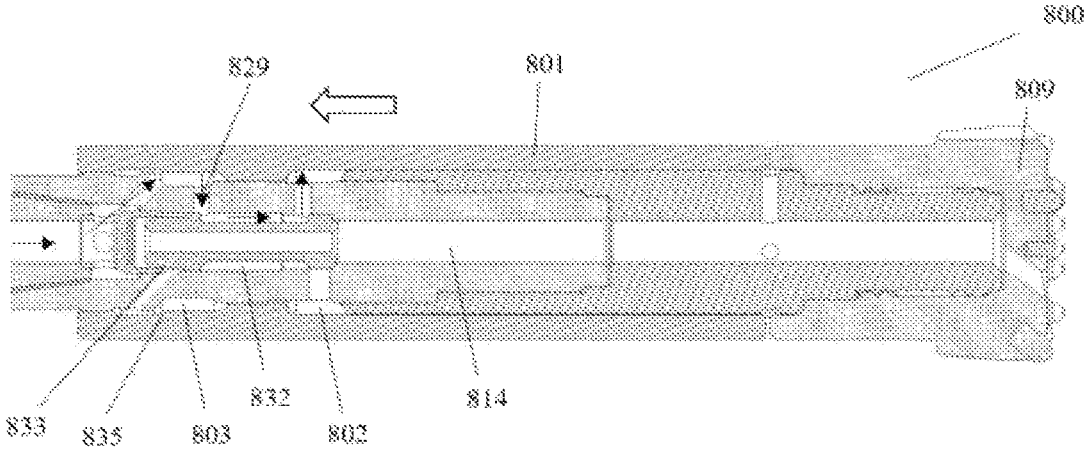
FIGS. 8*a* to 8*d* depict different stages of the hammer cycle of the hammer of FIGS. 7*a* and 7*b;*

An example of the hammer cycle for a disposable hammer including the valve of FIGS. 7*a* and 7*b* is illustrated in FIGS. 8*a* to 8*d*. In FIG. 8*a*, the piston 801 is moving in an upward or rearward direction (to the left as shown in the drawings). The rear chamber 803 is connected to pressure fluid throughout the hammer cycle. The forward chamber 802 is connected to high pressure fluid through the valve chamber 832 and the rear chamber 803, as shown by the arrows. The forward chamber has a bigger pressure area than the rear chamber, due to the increased internal diameter of the piston 801 so that the piston moves in a rearward direction. The valve pilot chamber 833 is pressurised through the front control edge 835 which has connected the pilot chamber to the rear chamber 803. The pilot chamber has a bigger pressure area than the valve chamber. The flow connection between the forward chamber 802 and the shaft bore 814 is closed and the flow connection between the forward chamber and the valve chamber 832 is open. The valve chamber is continuously connected to the rear chamber 803 via the rear outlet port 829.

Figure 8B:
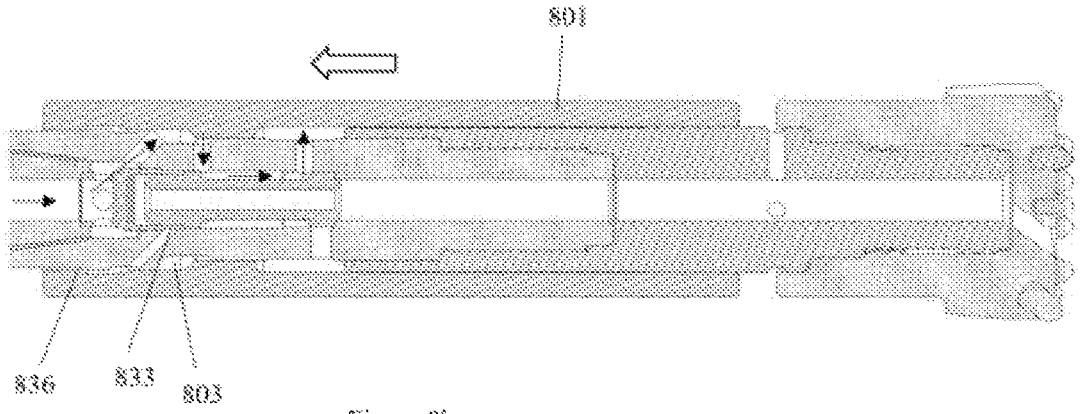

In FIG. 8*b*, the piston 801 has reached a point where a flow connection has been opened from the pilot chamber 833 to the ambient pressure via the rear control edge 836. The pressure in the pilot chamber will drop and there will be a net hydraulic force causing the valve 805 to switch.

Figure 8C:
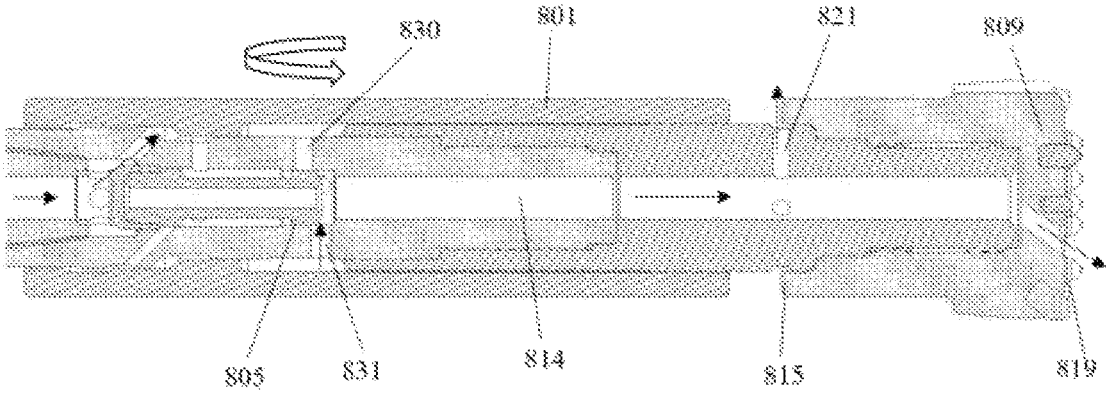

In FIG. 8*c*, the valve 805 has switched. The valve has closed the forward inlet port 830 and opened the forward outlet port 831 so that exhaust water flows into the shaft bore 814, as shown by the arrow. The hydraulic force reverses the direction of the piston 801 and drives it towards the drill bit 809. The main portion of the exhaust water will flow through the shaft bore and the bit to exit at the bit face 819, as shown by the arrows, to flush cuttings from the bit face. A small portion of the exhaust water will flow out through the radial holes or ports 821 located close to the bit strike face 815, as shown by the arrows, to flush cuttings from the strike faces of the bit and the piston.

Figure 8D:
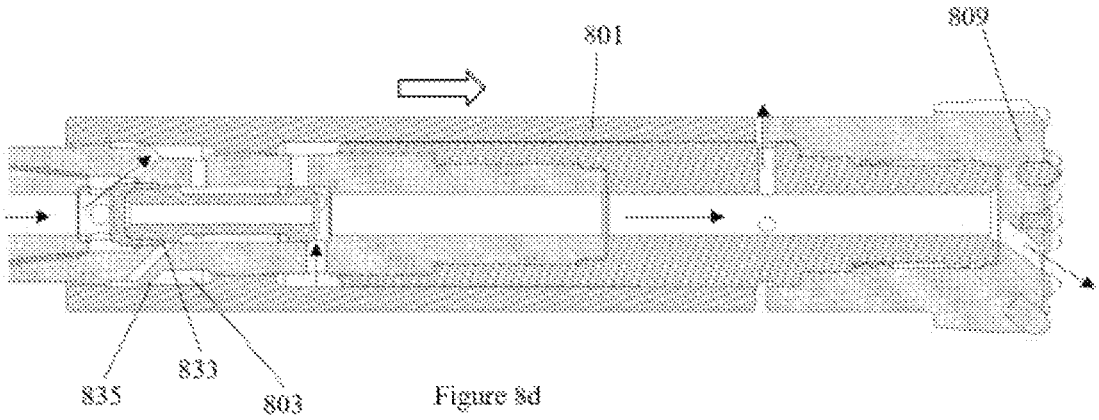

In FIG. 8*d*, the piston 801 is travelling towards the bit 809 (to the right as shown in the drawings). Just before the impact, the piston 801 will connect the pilot chamber 833 to the rear chamber 803 via the front control edge 835. This causes the valve to switch just after the piston has impacted the drill bit. The cycle begins again as shown in FIG. 8*a*.

Figure 9A:
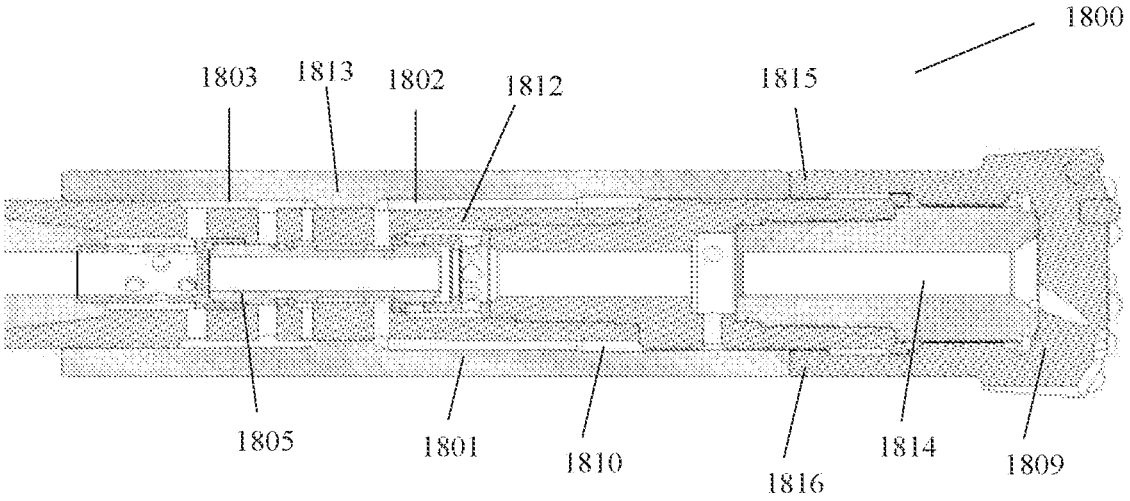
FIG. 9*a* is a cross-sectional view of a disposable water hammer according to an embodiment of the present invention.
Figure 9B:
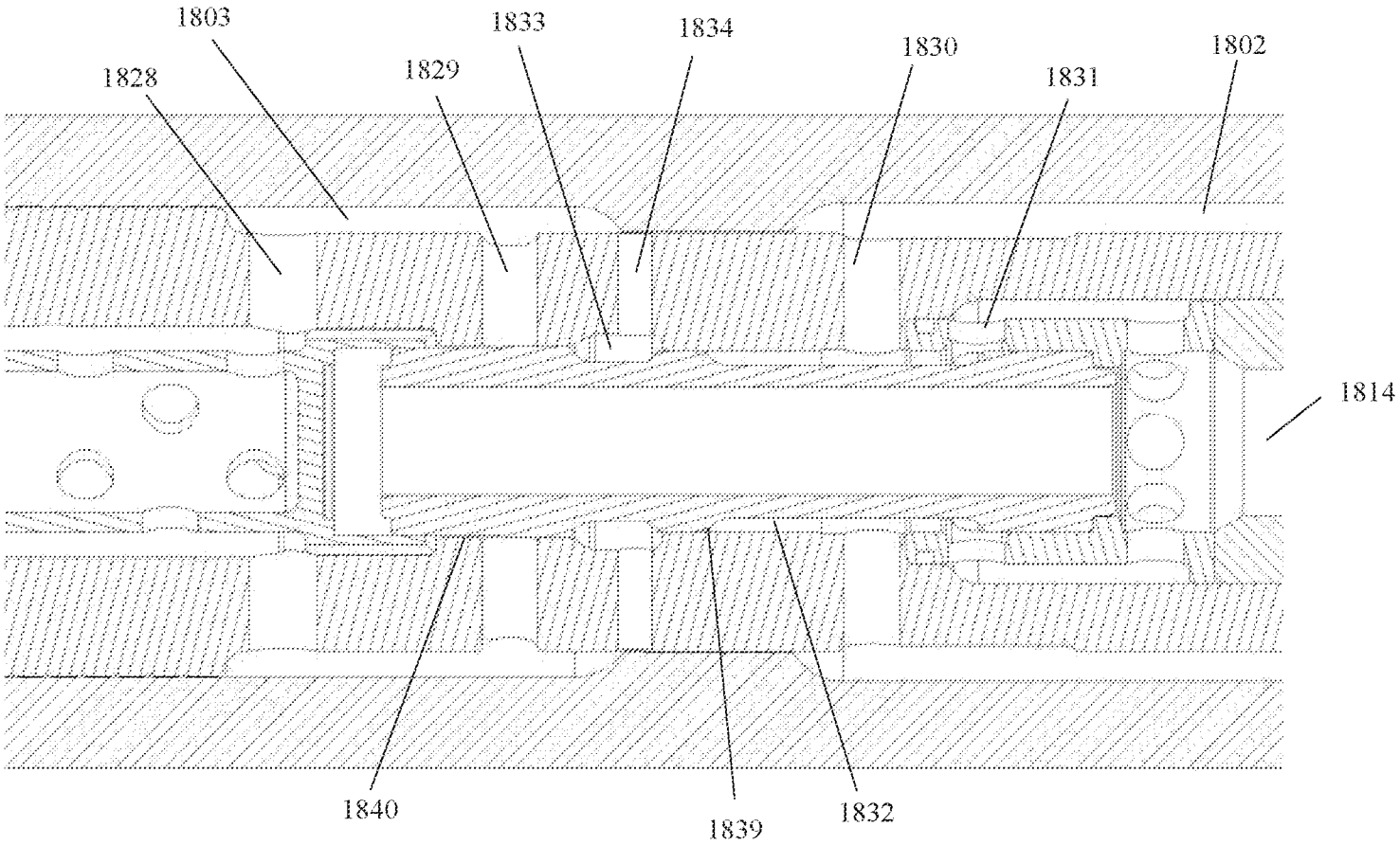
FIG. 9*b* is a detail view of a portion of the hammer of FIG. 9*a;*

A hydraulic down-the-hole hammer 1800 according to another embodiment of the invention is illustrated in FIGS. 9*a* and 9*b*. The hammer shown is a low-cost disposable or single-use hammer. However, various aspects of this embodiment may also be applied to multiple-use hammers. As in the embodiments described above, the hammer comprises an elongate shaft 1812 formed with a central bore 1814. A piston 1801 also has a central bore 1810 therethrough. The shaft is received within the piston bore such that the piston is slidably mounted for reciprocal movement on the shaft 1812 and arranged to impact an annular shoulder 1815 at a rear end 1816 of a percussion bit 1809. Forward 1802 and rear 1803 drive chambers for the piston are disposed between the piston 1801 and the shaft 1812. An annular shoulder 1813 on the piston formed internally of the piston bore 1810 separates the forward chamber 1802 from the rear chamber 1803. In this embodiment, an internal diameter of the piston 1801 to the rear of the shoulder 1813 is smaller than the internal diameter of the piston forward of the shoulder, such that the forward chamber has a larger driving area than the rear chamber. The hammer also comprises a control valve 1805 arranged within the central bore 1814 of the shaft to control reciprocation of the piston.

The control valve 1805 is illustrated in more detail in FIG. 9*b*. The valve 1805 comprises a top or rear inlet port 1828 and a top or rear outlet port 1829. The valve further comprises a bottom or forward inlet port 1830 and a bottom or forward outlet port 1831. Also shown in FIG. 9*b* are the valve undercut 1832, the pilot chamber 1833, the pilot port 1834, the valve shoulder 1839 and the valve high pressure chamber 1840.

Figure 10A:
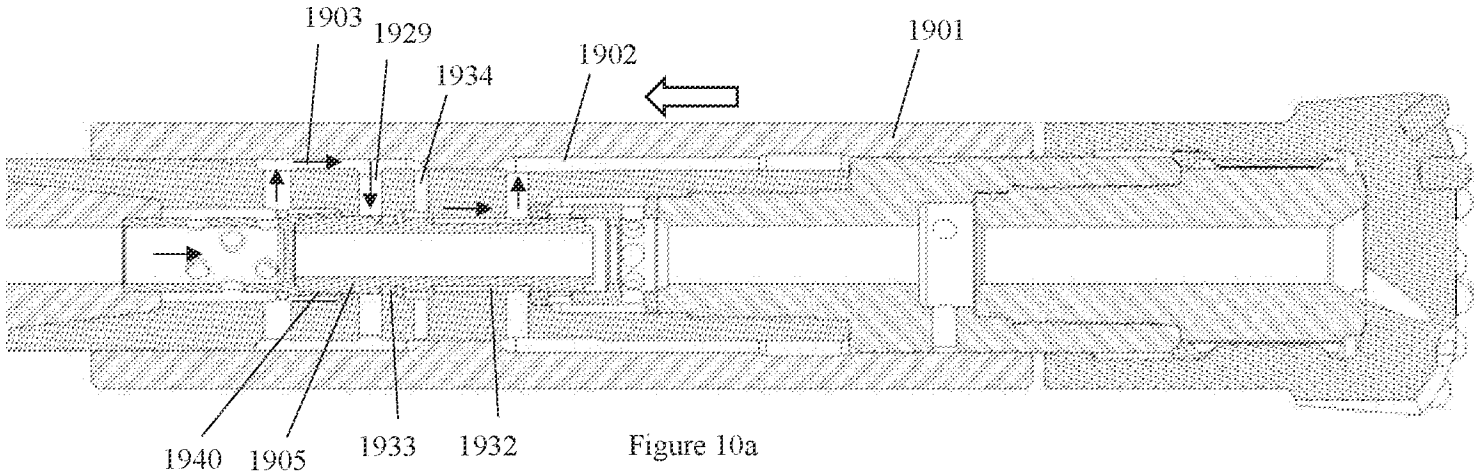
FIGS. 10*a* to 10*d* depict different stages of the hammer cycle of the hammer of FIGS. 9*a* and 9*b;*

An example of the hammer cycle for a disposable hammer including the valve of FIGS. 9*a* and 9*b* is illustrated in FIGS. 10*a* to 10*d*. In FIG. 10*a*, the piston 1901 is moving in an upward or rearward direction (to the left as shown in the drawings). The rear chamber 1903 is connected to pressure fluid throughout the hammer cycle. The forward chamber 1902 is connected to high pressure fluid through the rear outlet port 1929, the pilot chamber 1933, the valve undercut 1932 and the forward inlet port 1930, as shown by the arrows. The forward chamber has a bigger pressure area than the rear chamber, due to the increased internal diameter of the piston 1901 so that the piston moves in a rearward direction. The valve pilot chamber 1933 is pressurised through the pilot port 1934 and/or the rear outlet port 1929. The pilot chamber 1933 has a bigger pressure area than the valve high pressure chamber 1940, which is continuously connected to high pressure fluid. The flow connection between the forward chamber 1902 and the shaft bore 1914 is closed.

Figure 10B:
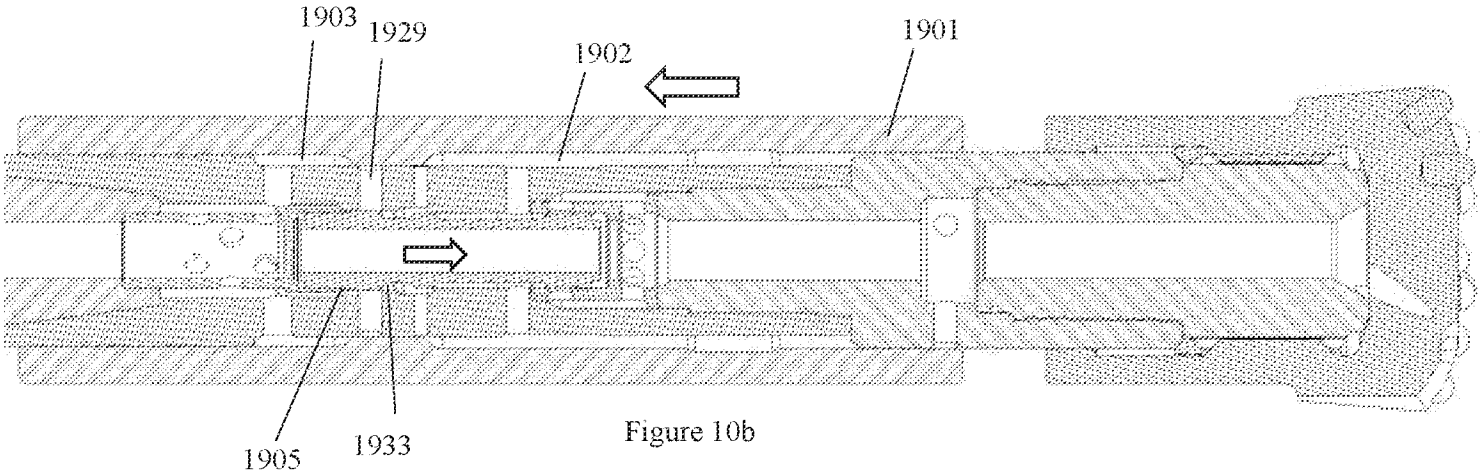

In FIG. 10*b*, the piston 1901 has reached a point where the piston disconnects the rear outlet port 1929 from the rear chamber 1903. The forward chamber 1902 does not receive pressure fluid from the rear chamber and the piston will continue to move upwards due to its inertia. The pressure in the forward chamber and in the pilot chamber 1933 will collapse and there will be a net hydraulic force causing the valve 1905 to switch.

Figure 10C:
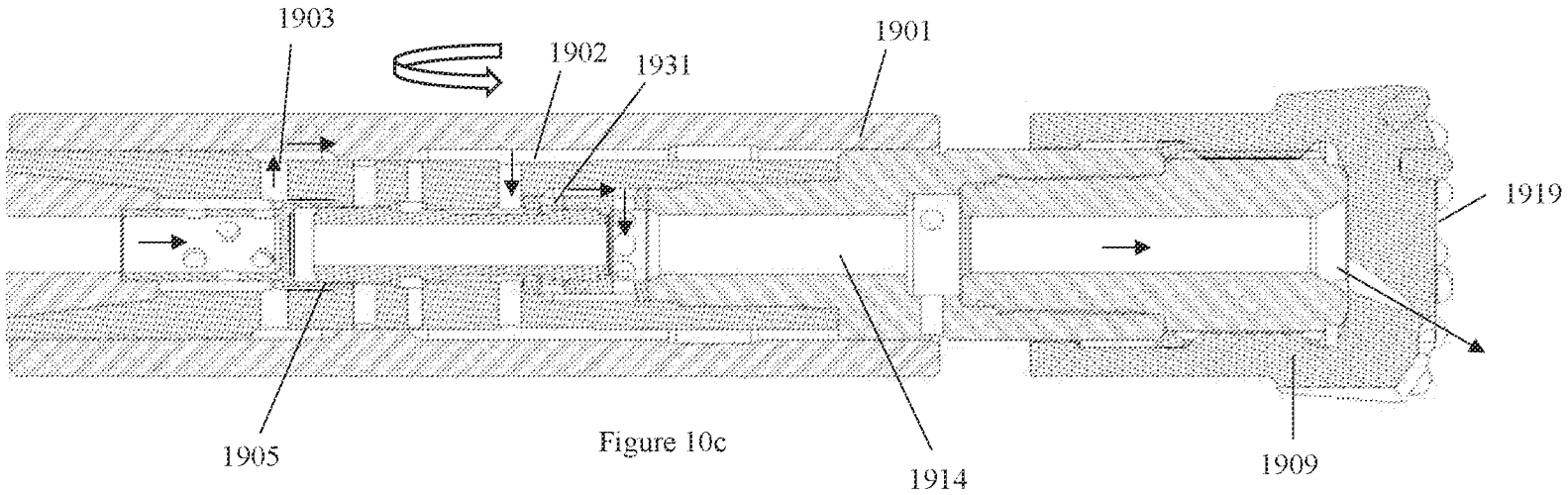

In FIG. 10*c*, the valve 1905 has switched. The valve has closed the flow connection between the rear chamber 1903 and the forward chamber 1902 and opened the forward outlet port 1931 so that exhaust water flows into the shaft bore 1914, as shown by the arrow. The hydraulic force reverses the direction of the piston 1901 and drives it towards the drill bit 1909. The exhaust water will flow through the shaft bore and the bit to exit at the bit face 1919, as shown by the arrows, to flush cuttings from the bit face. Although not shown, radial flushing ports may also extend from the central bore of the shaft to an outer surface of the shaft, allowing part of the exhaust fluid to exit between a forward end of the piston and the strike face of the bit, as described above.

Figure 10D:
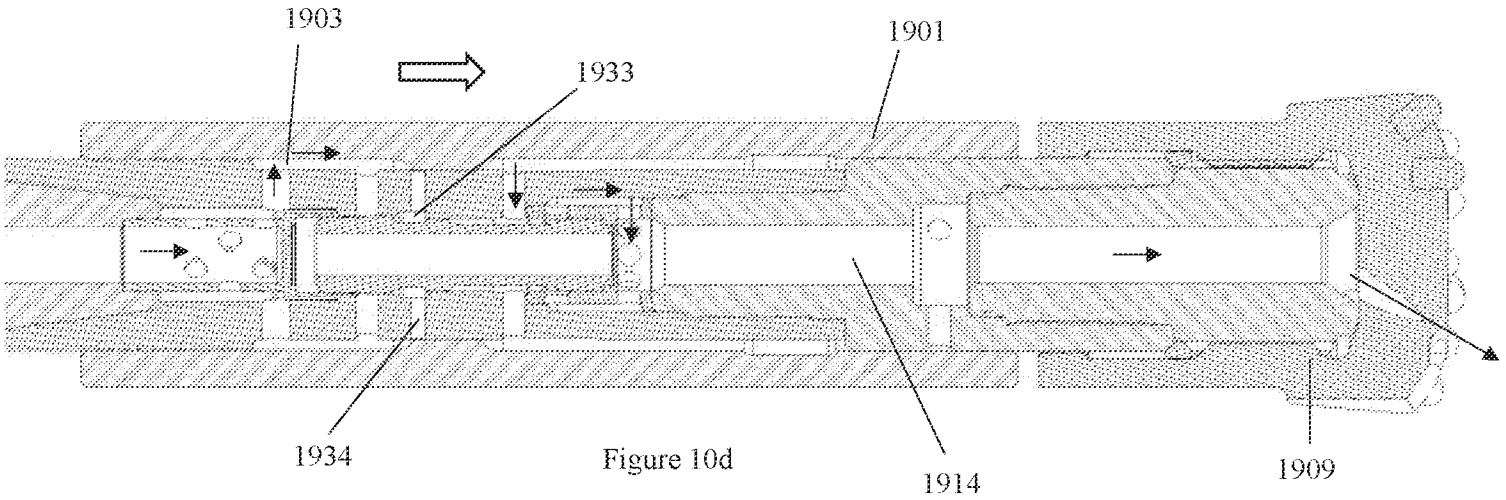

In FIG. 10*d*, the piston 1901 is travelling towards the bit 1909 (to the right as shown in the drawings). Just before the impact, the piston 1901 will connect the pilot chamber 1933 to the rear chamber 1903 via the pilot port 1934. This causes the valve to switch just after the piston has impacted the drill bit. The cycle begins again as shown in FIG. 10*a*.

Figure 11A:
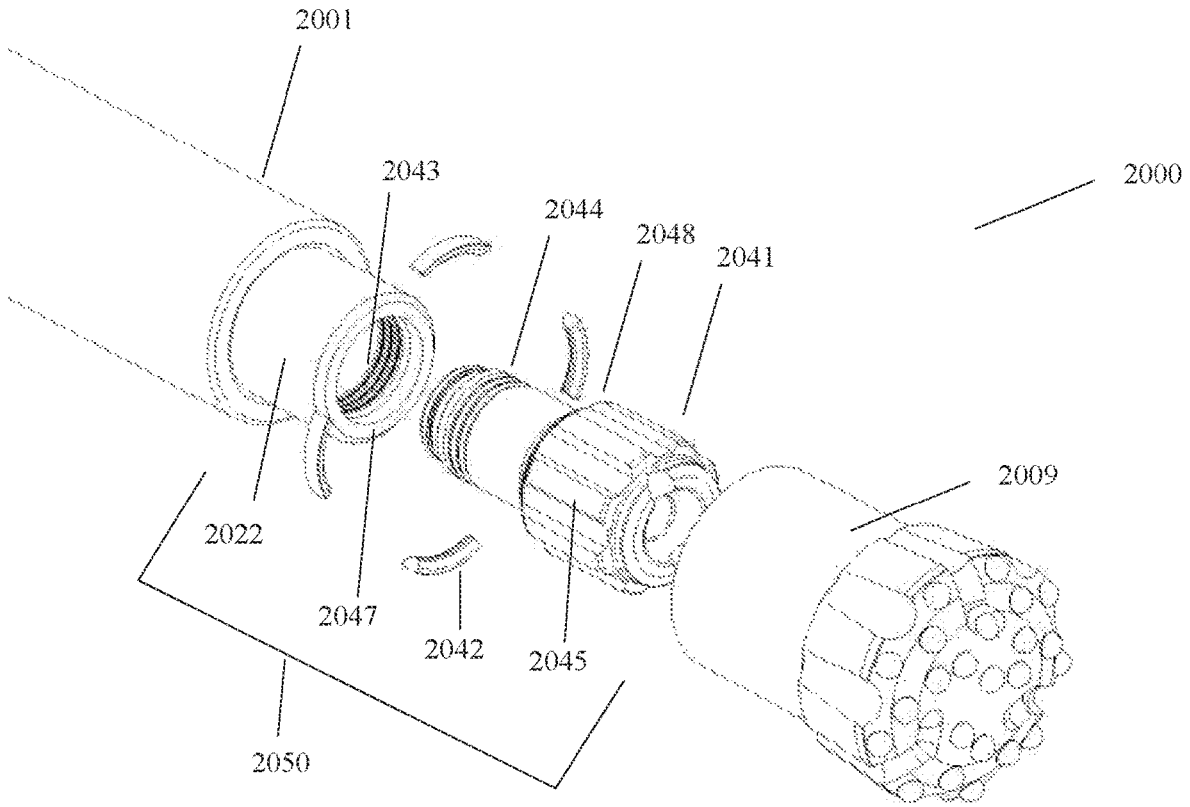
FIG. 11*a* is a perspective view of a coupling element, chuck and a bit of a hammer according to the present invention.
Figure 11B:
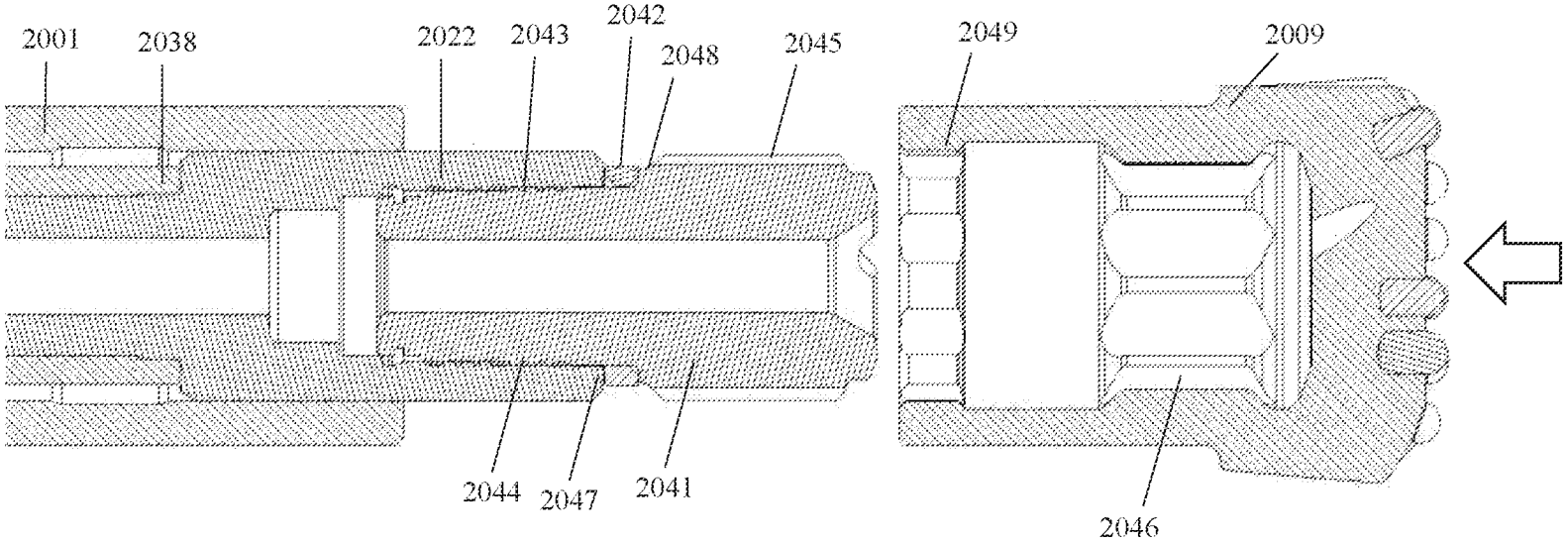
FIG. 11*b* is a cross-sectional view of the coupling element, chuck and bit of FIG. 11*a*, in which the chuck is assembled to the coupling element of the hammer.
Figure 11C:
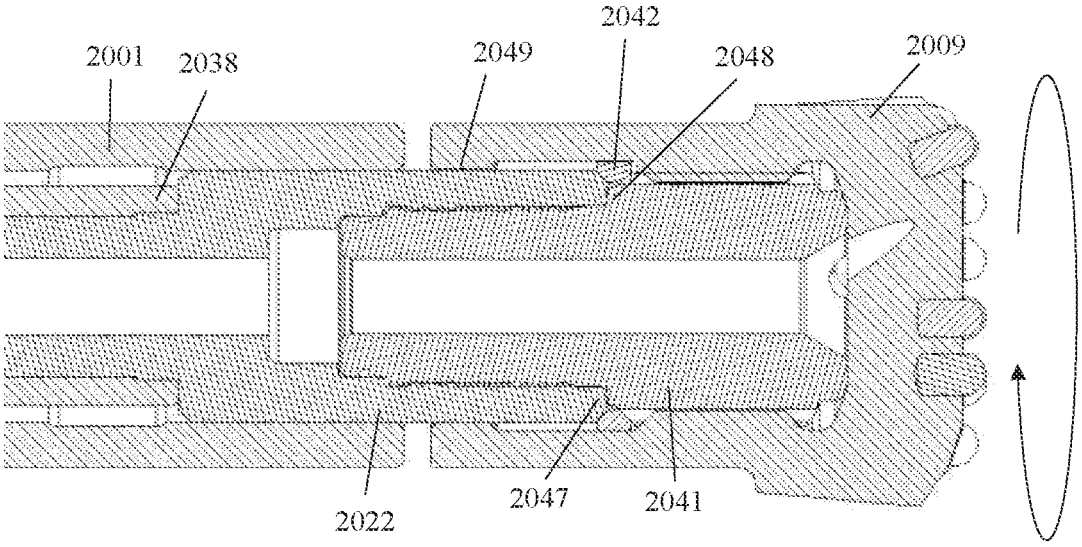
FIG. 11*c* is a cross-sectional view of the assembly of FIG. 11*b*, in which the bit is coupled to the chuck.

FIGS. 11*a*, 11*b* and 11*c* illustrate a coupling arrangement for coupling a percussion bit to a hammer according to the present invention. Hammer 2000 shown in FIGS. 11*a*, 11*b* and 11*c* is similar in several respects to disposable hammer 1800 shown in FIGS. 9*a* and 9*b* but the coupling arrangement shown may also be applied to other hammers in accordance with the invention.

The shaft 2012 of hammer 2000 comprises a coupling assembly 2050 at forward end 2023 thereof. The coupling assembly comprises a seal flange 2022 and a coupling element in the form of a chuck 2041. As shown in FIGS. 11*b* and 11*c*, an outer diameter of the seal flange is greater than an outer diameter of a main body 2038 of the shaft, so that the forward chamber is sealed by the seal flange and the piston 2001. The seal flange 2022 is formed with connection means comprising an internal screw thread 2043 at forward end thereof. Complementary connection means comprising an external screw thread 2044 are provided on a rear portion of the chuck. Engagement means, in the form of axially extending splines 2045 provided externally of the chuck, are engageable with complementary engagement means, in the form of corresponding splines 2046 provided internally of the bit 2009, whereby rotational drive from the shaft may be transmitted to the bit. In other embodiments, the chuck may be formed with a square, hexagonal or octagonal cross-section and the internal portion of the bit may be correspondingly shaped, as described above.

The hammer 2000 further comprises bit retaining means on the chuck engageable with complementary retaining means on the bit 2009 for longitudinal coupling of the bit to the hammer. In the embodiment shown in FIGS. 11*a*, 11*b* and 11*c*, the bit retaining means comprises a bit retaining ring 2042, comprising a plurality of part-annular sectors, and the complementary bit retaining means comprises a shoulder 2049 formed internally of the bit at a rear end thereof The bit is coupled to the hammer by screwing the screw thread 2044 on the chuck into the screw thread 2043 on the seal flange 2022. The seal flange is also connected to the main body 2038 of the shaft 2012 by way of a screw-threaded connection. Sufficient space is left between a forward end 2047 of the seal flange and an annular shoulder 2048 on the chuck to allow the sectors of the bit retaining ring 2042 to be inserted therebetween. The drill bit is then pushed over the chuck so that the splines 2045 on the chuck engage with the complementary splines 2046 on the drill bit. The screw-threaded connection between the chuck and the seal flange is then tightened by rotating the drill bit 2009. As the connection tightens, the annular shoulder 2048 on the chuck is pushed towards the forward end 2047 of the seal flange, thereby forcing the sectors of the bit retaining ring 2042 outwards, as shown in FIG. 11*c*. The drill bit is retained in the hammer by engagement between the shoulder 2049 and the bit retaining ring 2042.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Having described the invention, the following is claimed:

1. A hydraulic down-the-hole hammer comprising:

an elongate shaft;

a piston having a central bore therethrough, the piston slidably mounted for reciprocal movement on the shaft and arranged to impact a percussion bit, wherein forward and rear drive chambers for the piston are disposed between the piston and the shaft and wherein the forward chamber is separated from the rear chamber by an annular shoulder formed internally of the piston bore; and a control valve to control reciprocation of the piston, wherein the control valve is arranged within the central bore of the piston.

2. The hydraulic down-the-hole hammer as claimed in claim 1, wherein the shaft comprises a central bore and the control valve is arranged internally of the shaft.

3. The hydraulic down-the-hole hammer as claimed in claim 1, wherein the piston has a monolithic construction.

4. The hydraulic down-the-hole hammer as claimed in claim 1, wherein the piston is arranged to impact an annular shoulder at a rear end of the percussion bit.

5. The hydraulic down-the-hole hammer as claimed in claim 1, further comprising at least one accumulator arranged at a rear end of the piston.

6. The hydraulic down-the-hole hammer as claimed in claim 1, wherein:

a working fluid of the hammer is water;

the rear chamber is connected to a pressure fluid channel; and the control valve is arranged to connect the forward chamber to the rear chamber while the piston is moving in a rearward direction and arranged to connect the forward chamber to a flushing fluid channel through the central bore of the shaft and the percussion bit when the piston is moving in a forward direction.

7. The hydraulic down-the-hole hammer as claimed in claim 1, further comprising an outer wear sleeve, wherein the piston is housed within the outer wear sleeve and the percussion bit is arranged at a forward end of the outer wear sleeve.

8. The hydraulic down-the-hole hammer as claimed in claim 7, wherein the hammer is a closed-loop hammer and a flushing fluid channel is provided between the piston and the outer wear sleeve and through the percussion bit.

9. The hydraulic down-the-hole hammer as claimed in claim 7, wherein a working fluid of the hammer is water and wherein a flow annulus is provided between the piston and the outer wear sleeve and a flushing fluid channel is provided through the shaft and the percussion bit.

10. The hydraulic down-the-hole hammer as claimed in claim 1, wherein the piston is an outermost component of the hammer.

11. The hydraulic down-the-hole hammer as claimed in claim 10, further comprising:

a flushing port in the shaft extending from the central bore of the shaft to an outer surface of the shaft at a forward end of the piston.

12. The hydraulic down-the-hole hammer as claimed in claim 1, wherein the shaft comprises a coupling element at forward end thereof, wherein the coupling element couples the percussion bit to the hammer and transmits rotational drive thereto.

13. The hydraulic down-the-hole hammer as claimed in claim 12, further comprising engagement means formed on the coupling element engageable with complementary engagement means formed internally of the bit whereby rotational drive from the shaft may be transmitted to the bit.

14. The hydraulic down-the-hole hammer as claimed in claim 12, further comprising bit retaining means on the coupling element adapted for engagement with complementary retaining means on the bit to retain the bit in the hammer.

15. The hydraulic down-the-hole hammer as claimed in claim 14, wherein the bit retaining means comprises a first screw thread formed externally of the coupling element at a forward end thereof, and the complementary engagement means comprises a second screw thread formed internally of the bit.

* * * * *